US008193463B2

(12) United States Patent
Mae et al.

(10) Patent No.: US 8,193,463 B2
(45) Date of Patent: Jun. 5, 2012

(54) SWITCH

(75) Inventors: Kotaro Mae, Tokyo (JP); Hisashi Matsuhashi, Tokyo (JP)

(73) Assignee: Niles Co., Ltd., Tokyo (JP)

( * ) Notice: Subject to any disclaimer, the term of this patent is extended or adjusted under 35 U.S.C. 154(b) by 227 days.

(21) Appl. No.: 12/662,490

(22) Filed: Apr. 20, 2010

(65) Prior Publication Data

US 2010/0270137 A1 Oct. 28, 2010

(30) Foreign Application Priority Data

Apr. 22, 2009 (JP) ..... 2009-104362

(51) Int. Cl.
*H01H 9/00* (2006.01)

(52) U.S. Cl. ..... 200/313

(58) Field of Classification Search ..... 200/312, 200/314, 341, 310–311, 313, 315, 345
See application file for complete search history.

(56) References Cited

U.S. PATENT DOCUMENTS

| | | | | |
|---|---|---|---|---|
| 5,391,848 | A * | 2/1995 | Murphy | 200/314 |
| 6,747,226 | B2 * | 6/2004 | Watanabe | 200/520 |
| 7,394,034 | B2 * | 7/2008 | Ostendorf et al. | 200/314 |
| 7,786,395 | B2 * | 8/2010 | Ozias et al. | 200/314 |
| 2009/0000929 | A1 * | 1/2009 | Nishiyama et al. | 200/313 |

FOREIGN PATENT DOCUMENTS

JP 11-185558 A 7/1999

* cited by examiner

*Primary Examiner* — Edwin A. Leon
(74) *Attorney, Agent, or Firm* — Rader Fishman & Grauer, PLLC

(57) ABSTRACT

A switch includes push knobs and a lens for guiding light from the light source on the pc board to illuminate the push knobs for changing the distance between the incident surface of the lens and the light source by moving the lens by operating the push knobs. The lens has a recess groove intersecting the light path of the incident light to the lens. The pc board has a protruding wall protruding toward the lens at a position corresponding to the recess groove. Upon movement of the lens directed to reduce the distance between the incident surface and the light source, the protruding wall is inserted into the recess groove by an amount corresponding to the lens displacement to shield the light path in accordance with the displacement. Light amount for illuminating the push knobs is kept constant irrespective of the lens movement.

6 Claims, 7 Drawing Sheets

SWITCH

BACKGROUND OF THE INVENTION

1. Field of the Invention

The present invention relates to a switch for illuminating a knob.

2. Description of the Related Art

Japanese Unexamined Patent Application Publication No. 11-185558 discloses a switch which guides light rays from a light source to a knob via a light guiding member and a lens for illuminating the knob.

The switch is designed such that the incident light rays irradiated from the light source to the light guiding member are further irradiated to the lens from the lower portion at the substrate side. The incident light to the lens, which has been irradiated is guided to the knob so as to be illuminated.

The switch as disclosed above is designed to have the lens moved in association with the operation of the knob. The distance between the lens and the light guiding member for irradiating the light rays from the light source toward the lens varies as the knob is operated.

For example, when the knob is depressed to bring the lens into close to the light guiding member, the distance between the lens and the light guiding member is reduced to allow incidence of more light rays to the lens, thus increasing illumination luminance for the knob. When the lens is moved away from the light guiding member, the distance between the lens and the light guiding member is increased to reduce the amount of incident light rays to the lens, thus lowering illumination luminance for the knob.

Accordingly, the switch as disclosed in Japanese Unexamined Patent Application Publication No. 11-185558 changes the amount of incident light to the lens upon operation of the knob, thus largely changing the illumination luminance for the knob.

Accordingly, the switch designed to illuminate the knob is required not to largely change the illumination luminance for the knob upon its operation.

SUMMARY OF THE INVENTION

The present invention provides a switch which includes a knob used for operating a movable contact, a light source, and a lens for guiding a light ray from the light source to illuminate the knob. The lens is moved by operating the knob to change a distance between the lens and the light source. The lens is provided with a recess groove which intersects a light path of incident light to the lens. A protruding wall which protrudes toward the lens is formed on a substrate at a position corresponding to the recess groove. When the lens moves toward a direction to reduce the distance from the light source, the protruding wall is inserted into the recess groove by an amount corresponding to a displacement of the lens to shield the light path in accordance with the displacement.

According to the present invention, in the case where the lens is moved toward the direction to reduce the distance between the lens and the light source, the protruding wall is inserted into the recess groove of the lens by an amount corresponding to the displacement of the lens so as to shield the light path within the lens in accordance with the displacement.

The larger the amount of the incident light to the lens is increased as the lens is brought into close to the light source, the higher the level of shielding the light path by the protruding wall becomes. Meanwhile, the smaller the amount of the incident light to the lens is decreased as the lens is moved away from the light source, the lower the level of shielding the light path becomes. This makes it possible to keep the amount of the light for illuminating the knob substantially constant. As a result, large change in the illumination luminance for the knob may be prevented irrespective of change in the distance between the lens and the light source upon operation of the knob.

DESCRIPTION OF THE PREFERRED EMBODIMENT

An embodiment according to the present invention will be described.

Figure 1:
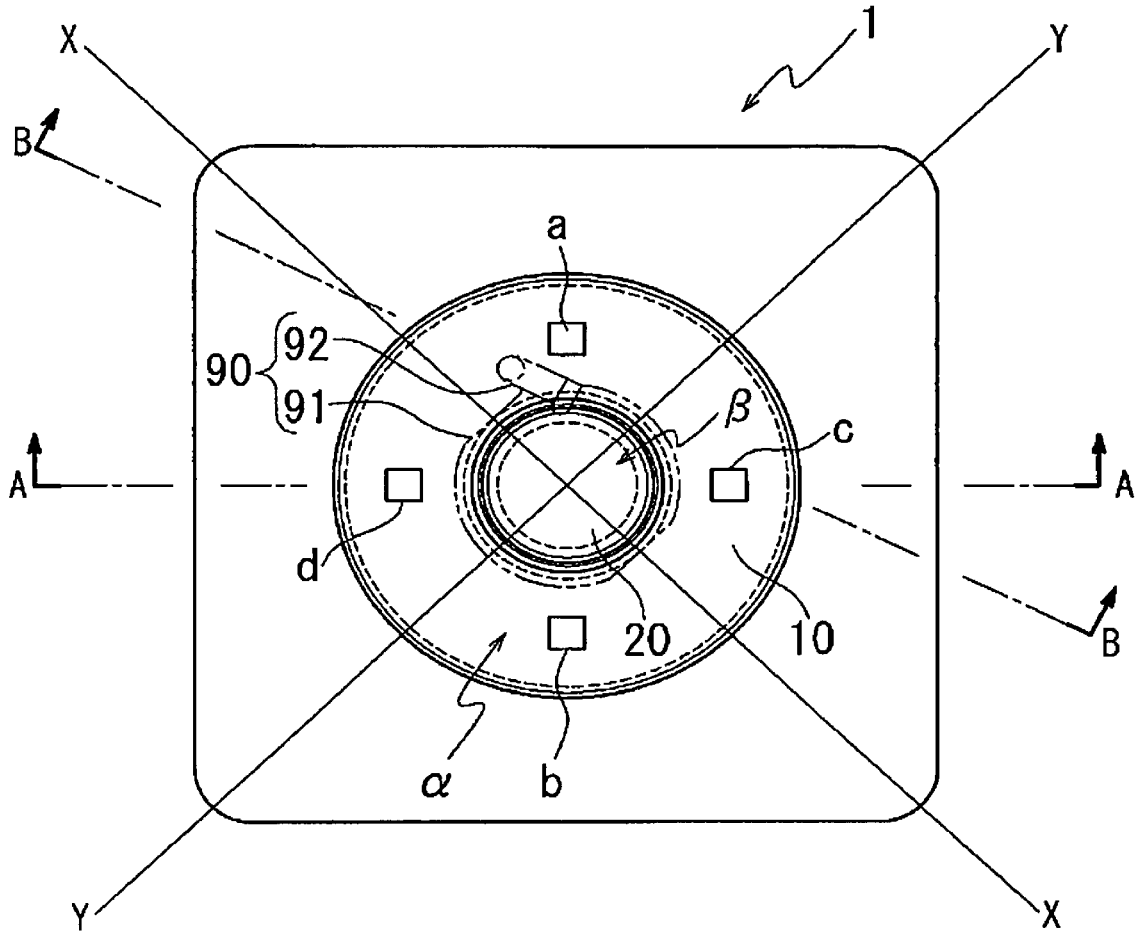
FIG. 1 is a plan view of a switch according to an embodiment.

FIG. 1 is a plan view of a switch 1 according to the embodiment.

Referring to FIG. 1, the switch 1 according to the embodiment has a ring-shaped push knob 10 and a circular push knob 20 exposed on its upper surface, which may be buried in a steering wheel of a vehicle for operating an on-board equipment.

The push knob 10 is a four-way switch which includes operation positions circumferentially arranged at an angular interval of 90°. For example, the operation positions to be depressed by the user for operating the equipment are located at regions a to d each designated with a "square" mark as illustrated in the drawing.

The push knob 10 includes a ring-shaped region a defined by the dotted lines as a surface illuminated by light rays irradiated from a light source disposed inside the switch 1.

The push knob 20 has an entire surface serving as the operation member, and a circular region β enclosed by the center dotted line serving as the surface to be illuminated. Both the push knobs 10 and 20 are formed of the light transmissive resin material.

Figure 2:
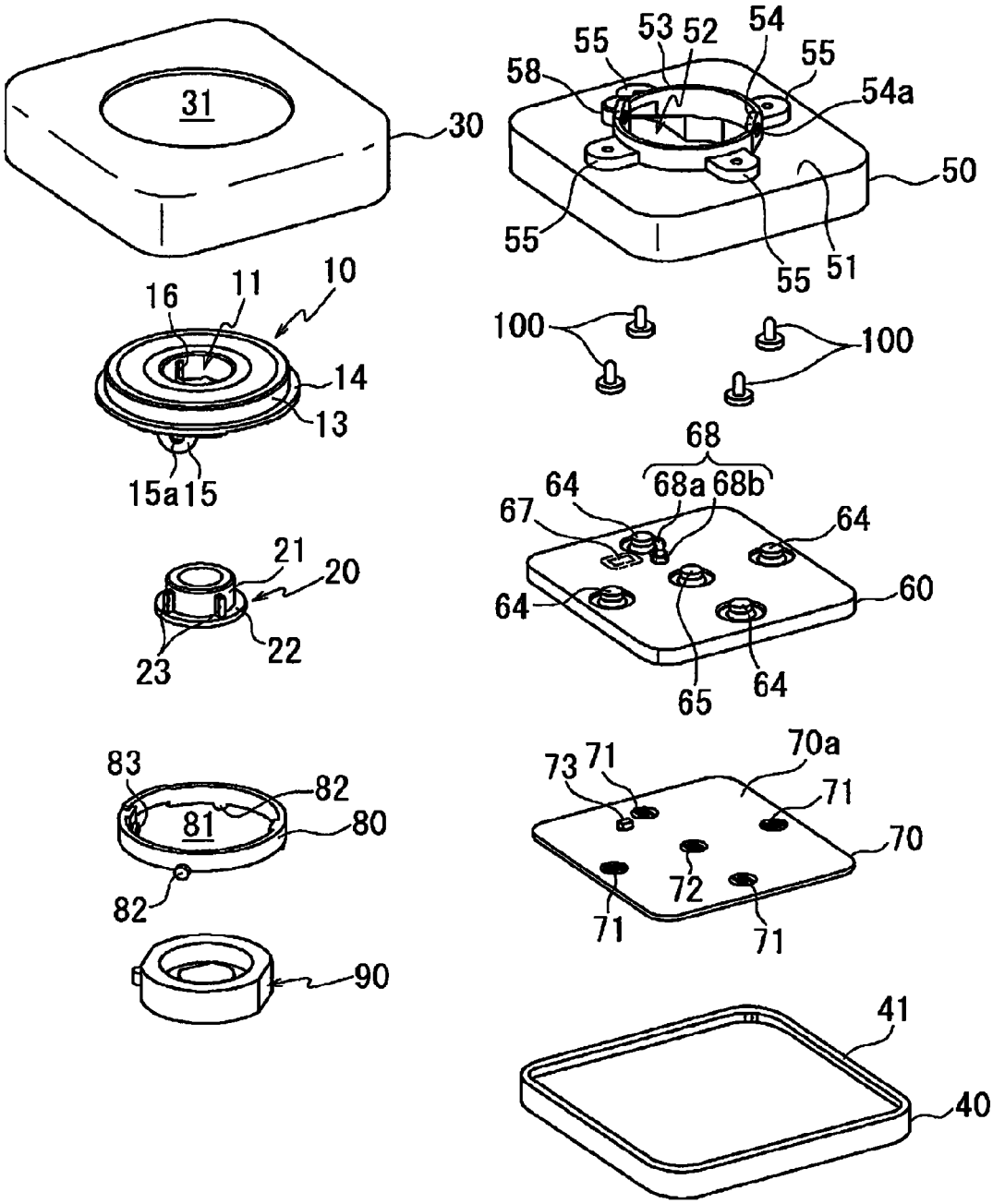
FIG. 2 is an exploded perspective view of the switch according to the embodiment.

FIG. 2 is an exploded perspective view of the switch 1 shown in FIG. 1.

Referring to FIG. 2, the switch 1 is formed by assembling a base 50, a rubber contact sheet 60, a pc board 70 and the like with a main body case which includes an upper case 30 and a lower case 40.

The push knob 10 is attached to the base 50 via a joint 80, and a lens 90 is disposed at the inner side of the joint 80 and interposed between the push knob 20 and the rubber contact sheet 60.

The upper case 30 has a rectangular top view, and an opening 31 formed at the center, through which upper surfaces of the push knobs 10 and 20 are exposed.

Figure 3:
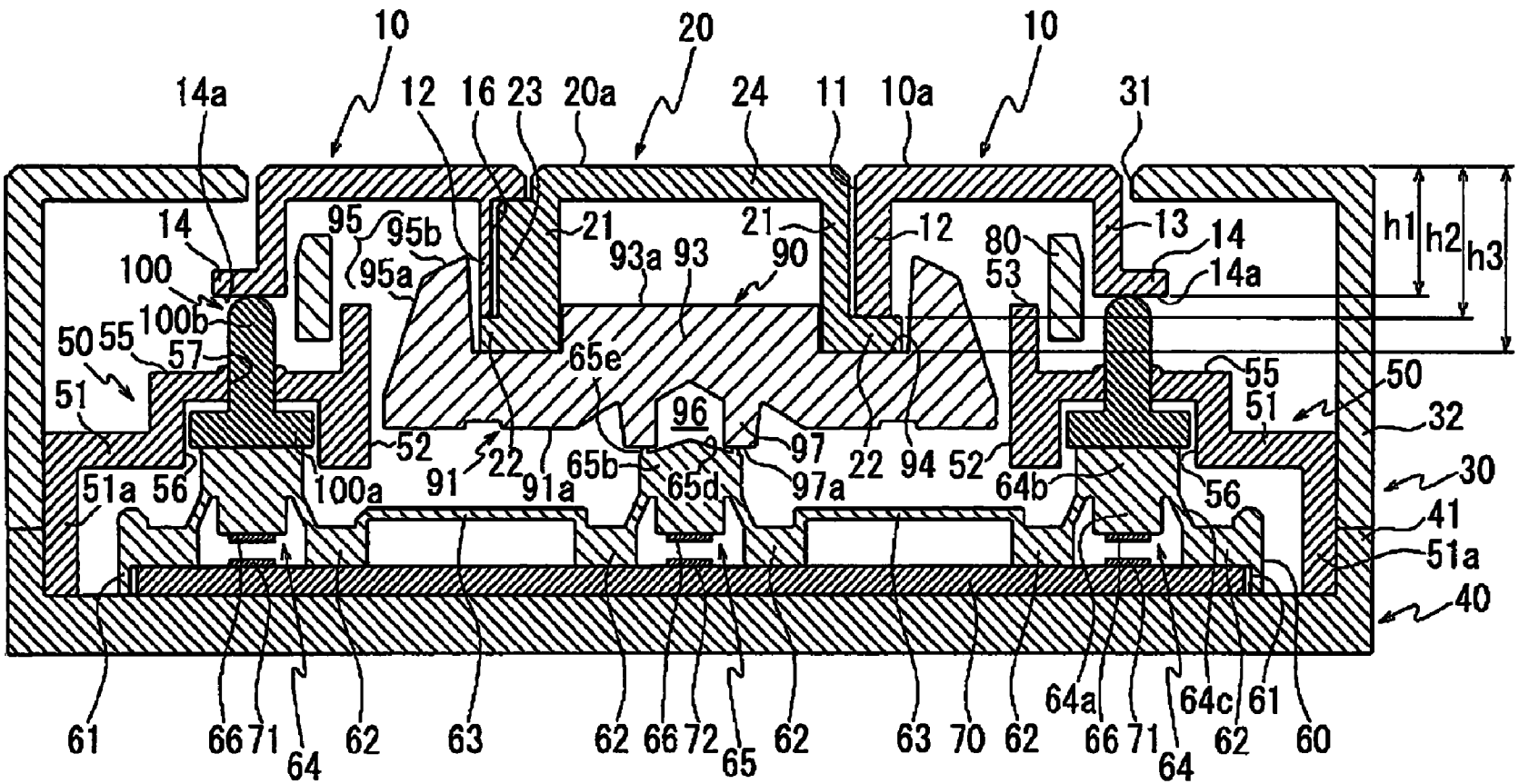
FIG. 3 is a cross-sectional view taken along line A-A of FIG. 1.

FIG. 3 is a cross-sectional view taken along line A-A of FIG. 1.

Referring to FIG. 3, the push knob 10 includes an inner wall 12 which surrounds an opening 11 formed at the center over the entire circumference, and extends downward (direction of lens 90) from the surface opposite a light emitting surface 10*a*. An outer wall 13 which extends in the same direction as the inner wall 12 is disposed around the outer circumferential edge of the push knob 10 to surround the inner wall 12 at a predetermined interval.

An extending length h1 of the outer wall 13 is set to be shorter than an extending length h2 of the inner wall 12. A flange portion 14 which extends outward in the radial direction is formed at the lower end of the outer wall 13. The flange portion 14 is formed over an entire circumference of the outer wall 13 of the push knob 10 when seen from above. A lower surface 14*a* of the flange portion 14 serves as a depression surface with which a push rod 100 (to be described later) is depressed toward the pc board 70.

Referring to FIG. 2, the push knob 10 is provided with attachments 15 which protrude downward from a lower end of the outer wall 13.

The attachments 15 are oppositely positioned with respect to the opening 11 when seen from above. The push knob 10 is supported at the joint 80 by internally inserting an outer protrusion 82 of the joint 80 (to be described later) into a hole 15*a* of the attachment 15 outward in the radial direction so as to be swingable around the single axis (axis designated with line Y-Y of FIG. 1).

As shown in FIG. 3, the push knob 20 has a cylindrical shape with a bottom. A flange portion 22 which extends radially outward is formed on the lower end of a peripheral wall 21 which extends downward from the circumferential edge of an upper wall 24 over an entire circumference.

A length h3 of the peripheral wall 21 is set to be longer than the length h2 of the inner wall 12 of the push knob 10. The push knobs 10 and 20 are assembled while having the lower end of the inner wall 12 of the push knob 10 mounted on the upper surface of the flange portion 22 of the push knob 20 in the switch 1.

Three protrusions 23 which extend in the axial direction (vertical direction in FIG. 3) are provided on the outer circumferential surface of the peripheral wall 21 along the circumferential direction at angular intervals of 90°, respectively (see FIG. 2). The protrusion 23 is formed in the range from the surface opposite a light emitting surface 20*a* of the upper wall 24 of the push knob 20 to the flange portion 22.

The protrusion 23 has a width corresponding to a guide groove 16 (see FIG. 2) formed in the inner wall 12 of the push knob 10, and serves as a guide for the vertical movement of the push knob 20 disposed inside the opening 11 of the push knob 10.

The joint 80 with a ring-shaped top view is provided with outer protrusions 82 each with a columnar shape, protruding radially outward at opposite positions with respect to a center opening 81, specifically, at the lower end of the intersection between the line Y-Y of FIG. 1 and the joint 80.

Referring to FIG. 3, the outer diameter of the joint 80 is set to be smaller than an inner diameter of the outer wall 13 of the push knob 10. Upon assembly of the joint 80 with the push knob 10, at least the upper half of the joint 80 is disposed in the space surrounded by the outer wall 13 of the push knob 10 when seen as a cross-sectional view.

As illustrated in FIG. 2, columnar shaped inner protrusions 83 which protrude radially inward are formed on the inner circumferential surface of the joint 80 at the lower end of the opposite positions with respect to the center opening 81.

The inner protrusions 83 are disposed at positions angularly offset at 90° in the circumferential direction of the joint 80 from the outer protrusion 82. The inner protrusion 83 is externally inserted into a hole 54*a* of a joint attachment 54 formed on the base 50 (to be described later) in the radial direction inward such that the joint 80 is swingably supported around the single axis (axis designated with line X-X of FIG. 1) in the base 50.

As the swing axis (axis designated with line X-X of FIG. 1) of the joint 80 intersects the swing axis (axis designated with line Y-Y of FIG. 2) of the push knob 10, the joint 80 with which the push knob 10 is assembled is attached to the base 50 such that the push knob 10 becomes swingable around two axes designated with lines X-X and Y-Y of FIG. 1.

Accordingly, the operation positions (square marks in the drawing) are set on the push knob 10 circumferentially at the angular interval of 90° based on the swinging direction.

Figure 4A:
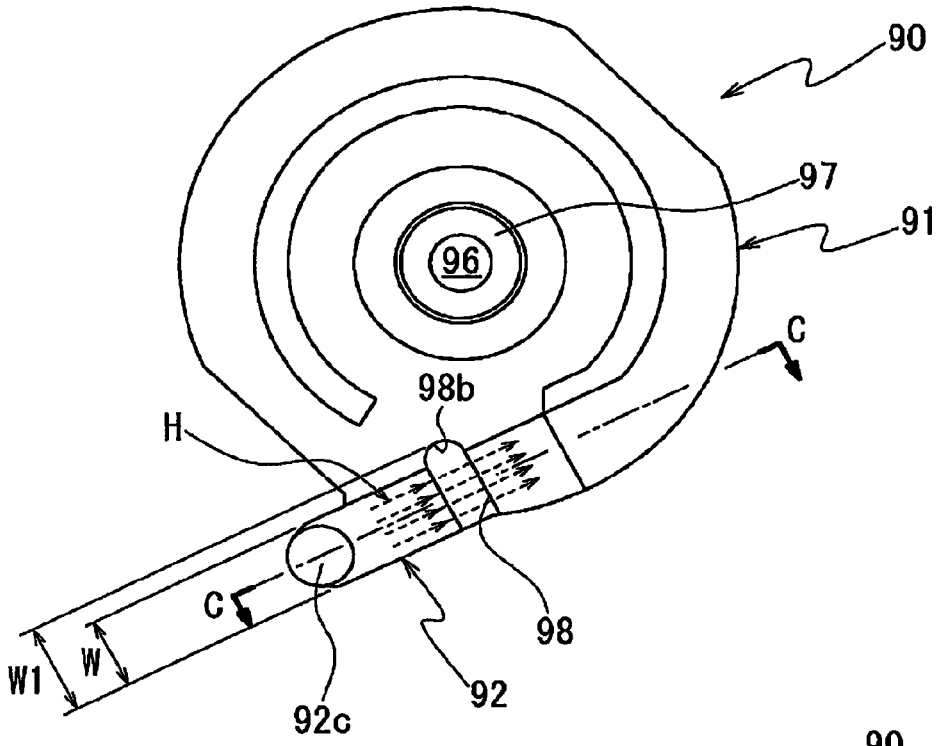
FIGS. 4A and 4B are explanatory views each illustrating a lens of the switch according to the embodiment.
Figure 4B:
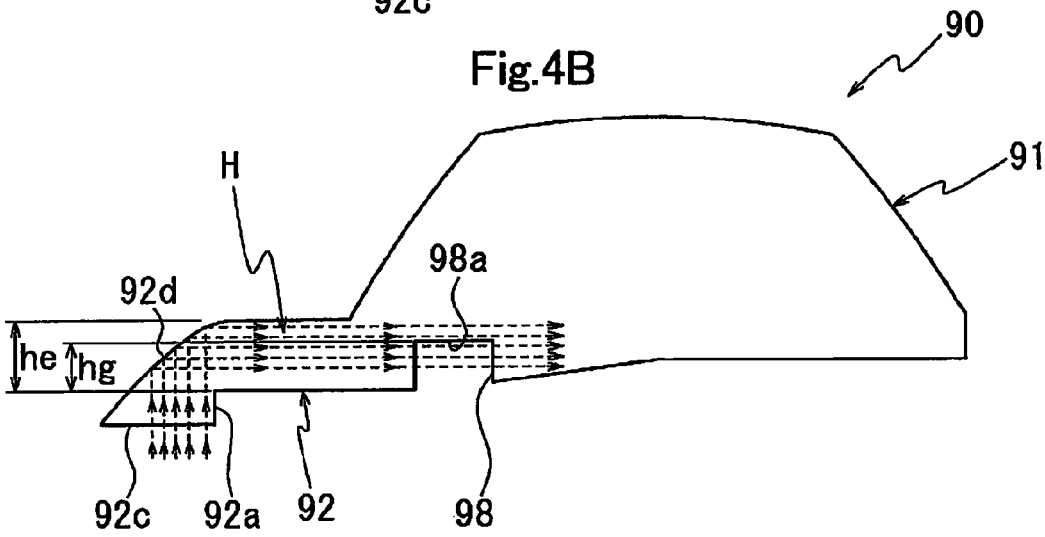

FIG. 4A is a plan view of the lens 90 when seen from the lower case 40. FIG. 4B is an enlarged cross-sectional view taken along line C-C of FIG. 4A, and schematically illustrates the light path H of the incident light to the lens 90 from an incident surface 92*c*.

The lens 90 includes a substantially circular main body 91 as a plan view, and an extending portion 92 which extends from the end of the main body 91 to the tangential direction. As two-dot chain line in FIG. 1 shows, the lens 90 is disposed such that the main body 91 is located below the push knob 20, and the extending portion 92 protrudes below the push knob 10.

As illustrated in FIG. 3, the upper surface of the main body 91 of the lens 90 serves as an output surface for outputting the incident light from the light source 73 (to be described later) toward the push knobs 10 and 20.

An upwardly extending columnar portion 93 with an outer diameter corresponding to the inner diameter of the peripheral wall 21 of the push knob 20 is formed at the center of the main body 91. The upper end surface of the columnar portion 93 serves as an output surface 93*a* for outputting the light toward the push knob 20 located above.

A ring-shaped recess portion 94 is further formed to surround the columnar portion 93, which serves as a support portion for supporting the push knob 20 by allowing the flange portion 22 formed at the lower end of the push knob 20 to rest thereon.

A peripheral wall 95 which surrounds the ring-shaped recess portion 94 has its diameter reduced as it is brought upward from the position apart from a lower surface 91*a* at the side of the pc board 70 by a predetermined distance. The diameter is further reduced from the position which is brought over the output surface 93*a* of the columnar portion 93, resulting in output surfaces 95*a* and 95*b* for outputting the light toward the push knob 10.

A substantially columnar shaped opening 96 and a cylindrical support member 97 for surrounding the opening 96 are formed at the lower surface 91*a* of the main body 91.

A lower end 97*a* of the support member 97 downwardly extends to be lower than the lower surface 91*a* of the main body 91, and is supported at a depressing portion 65*b* (protrusion 65*e*) of a switch 65 (to be described later).

Figure 5:
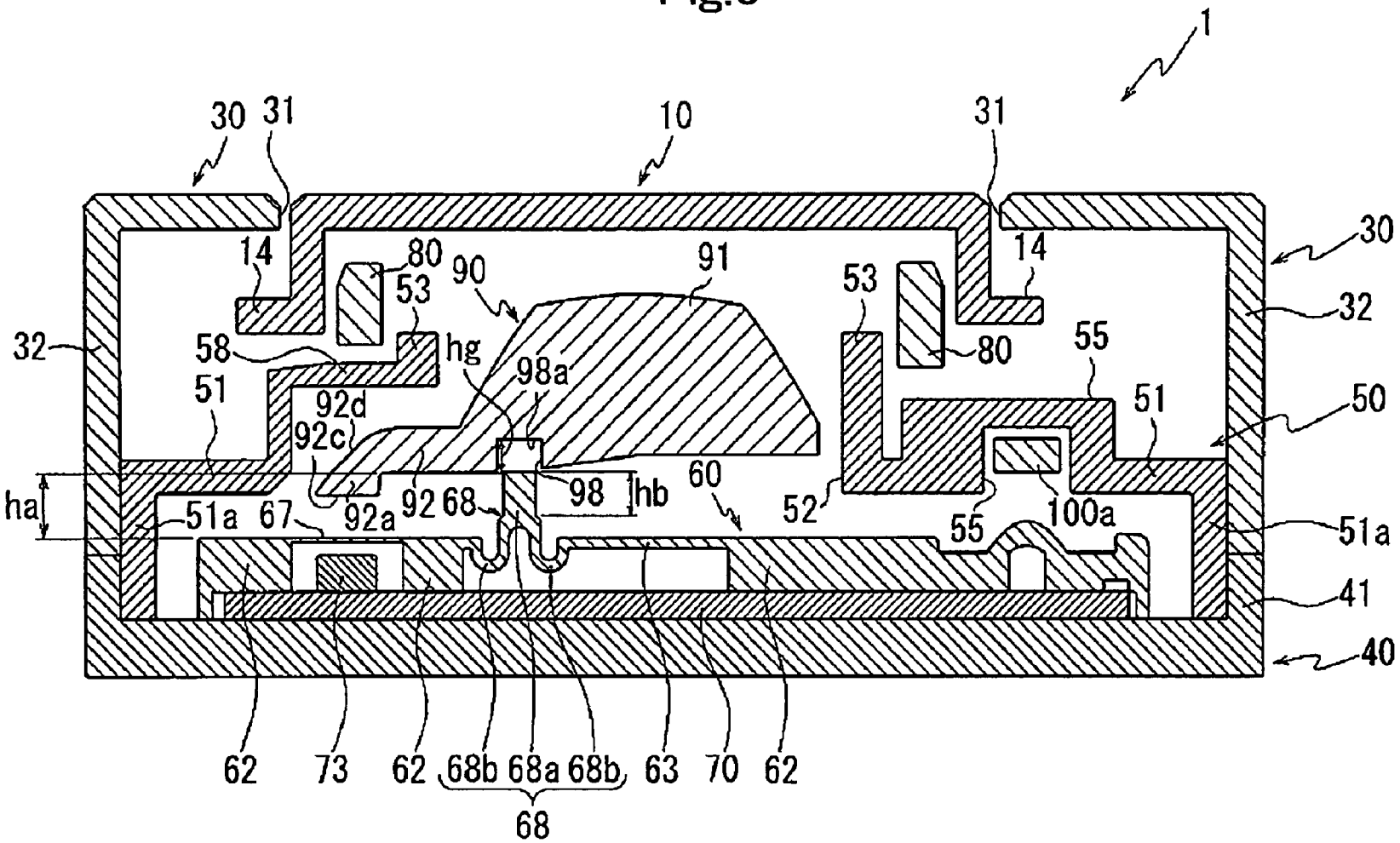
FIG. 5 is a cross-sectional view taken along line B-B of FIG. 1.

FIG. 5 is a cross-sectional view taken along line B-B of FIG. 1, representing a positional relationship between a recess groove 98 of the lens 90 and a protruding wall 68 of the rubber contact sheet 60.

Referring to FIGS. 4A, 4B and 5, a leading end of the extending portion 92 of the lens 90 is provided with a protrusion 92*a* which protrudes toward the pc board 70. The lower end surface of the protrusion 92*a* serves as an incident surface 92*c* for receiving incidence of the light irradiated from the light source 73. The upper surface of the protrusion 92*a* serves as a slope surface 92*d* which reflects the incident light from the incident surface 92*c* for changing the direction of the light toward the main body 91 of the extending portion 92.

As illustrated in FIGS. 4A and 4B, the recess groove 98 is formed on the light path H on which the light after incidence to the lens 90 from the incident surface 92*c* is reflected on the slope surface 92*d* and directed from the extending portion 92 to the main body 91 across the direction orthogonalized to the light path H. As illustrated in FIG. 5, the recess groove 98 is opened in the lower surface of the lens 90 at the side of the rubber contact sheet 60.

Referring to FIG. 4A, the recess groove 98 has a length W1 which is larger than the width W of the extending portion when seen from above. An end portion 98*b* of the recess groove 98 at the center (opening 96) side of the lens 90 forms a curve conforming to the contour of the end portion of an insertion portion 68*a* of the protruding wall 68 (to be described later).

Referring to FIG. 4B, the recess groove 98 has a depth hg smaller than the thickness he of the extending portion 92 when seen as the cross-section so as not to intersect all the light rays directed to the main body 91.

The embodiment is structured so that the recess groove 98 substantially intersects the light path H. In the state where the insertion portion 68*a* of the protruding wall 68 (to be described later, see FIG. 5) is not inserted into the recess groove 98, the light traveling from the slope surface 92*d* toward the main body 91 passes through the recess groove 98 while keeping the direction.

The light guided into the main body 91 after passing over the region of the recess groove 98 is distributed entirely on the main body 91 while reflecting therein, and is output from the output surfaces 93*a*, 95*a* and 95*b* (see FIG. 3) formed on the upper portion toward the corresponding push knobs 20 and 10, respectively.

Referring to FIGS. 2 and 3, an opening 52 for accommodating the lens 90 therein is formed in the center of an upper wall 51 of the base 50. A peripheral wall 53 which extends upward is formed along the circumference of the opening 52.

As illustrated in FIG. 2, joint attachments 54 are oppositely disposed on the peripheral wall 53 with respect to the opening 52. A hole 54*a* through which an inner protrusion 83 of the joint 80 is inserted is formed in the joint attachment 54. The joint 80 is swingably supported at the base 50 around the single axis (axis designated by the line X-X of FIG. 1).

Push rod attachments 55 each outwardly extending in the radial direction are formed on the peripheral surface of the peripheral wall 53 of the base 50 circumferentially at the angular interval of 90°.

Referring to FIG. 3, the push rod attachment 55 is formed to protrude upward from the upper wall 51 of the base 50, and forms a storage portion 56 for storing a depression portion 100*a* of a push rod 100 to be described later, and a vertically penetrating insertion hole 57 through which a shaft 100*b* of the push rod 100 is inserted.

The push rod 100 has the depression portion 100*a* mounted on a switch 64 to be described later, and an upper end of the shaft 100*b* abutted on a lower surface 14*a* of the flange portion 14 of the push knob 10, which is movably disposed up and down in the drawing.

As illustrated in FIGS. 2 and 5, a light shielding wall 58 which protrudes toward the push knob 10 is formed on the upper wall 51 in the range just above the extending portion 92 of the lens 90.

The light shielding wall 58 extends over an entire region above the extending portion 92 from the position just above the incident surface 92*c* of the extending portion 92 so as to be covered while avoiding the contact therewith. It is provided to shield the incident light to the incident surface 92*c*, which has leaked from the upper portion of the extending portion 92 so as not to directly irradiate the push knob 10.

As illustrated in FIGS. 3, 4A and 4B, the base 50 is attached to the lower case 40 by fitting the peripheral wall 51*a* extending from the circumferential edge of the upper wall 51 to the lower case 40 with the peripheral wall 41 thereof through spigot joint. In the aforementioned state, a peripheral wall 32 of the upper case 30 is further fitted with the peripheral wall 51*a* of the base 50 through spigot joint to form the main body case of the switch 1, which is formed of the upper case 30 and the lower case 40.

Figure 6:
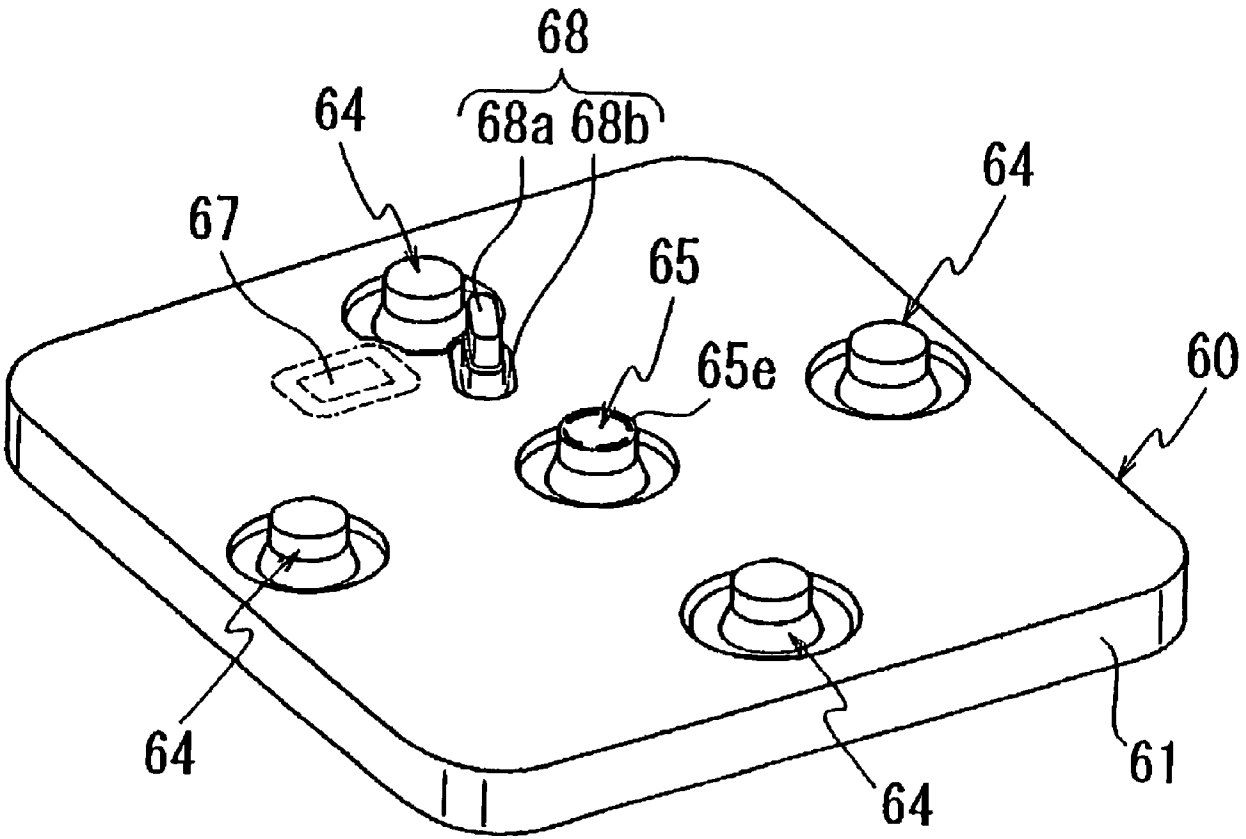
FIG. 6 is an explanatory view of a rubber contact sheet.

FIG. 6 is a perspective view of the rubber contact sheet 60.

As illustrated in FIG. 3, the rubber contact sheet 60 is mounted on the pc board 70 by externally fitting a peripheral wall 61 with the circumferential edge of the pc board 70 disposed in the lower case 40.

The rubber contact sheet 60 includes a mount portion 62 mounted on the pc board 70, an upper wall 63 for connecting the mount portions 62, the switches 64, 65, and the protruding wall 68 (see FIGS. 5 and 6) to be inserted into the recess groove 98 of the lens 90. The aforementioned elements are integrally formed of a rubber material with excellent flexibility and elasticity.

As illustrated in FIGS. 3 and 5, the mount portion 62 is formed to surround fixed contacts 71, 72 and the light source 73 which expose on the pc board 70.

Referring to FIG. 3, the switch 64 is formed of the fixed contact 71 which exposes on the surface of the pc board 70, a cylindrical portion 64*a* having a movable contact 66 paired with the fixed contact 71 on the lower surface, a substantially cylindrical depression portion 64*b* with diameter slightly larger than the cylindrical portion 64*a*, which is formed thereon, and a peripheral wall 64*c* which extends from the circumferential edge at the lower end of the depression portion 64*b* toward the mount portion 62.

The peripheral wall 64*c* is formed to have its inner diameter increased as it is apart from the depression portion 64*b*, and its, leading end connected to the mount portion 62. The peripheral wall 64*c* allows the depression portion 64*b* to be disposed at a position above the pc board 70 apart therefrom by a predetermined distance, and has the movable contact 66 of the cylindrical portion 64*a* connected to the lower end of the depression portion 64*b* positioned apart from the fixed contact 71 on the pc board 70.

The switch 64 is disposed while allowing the depression portion 64*b* to urge the push rod 100 on the push knob 10.

The push knob 10 is depressed through operation of the user to push the push rod 100 toward the pc board 70. The push rod 100 then urges the switch 64 on the pc board 70.

At this time, the peripheral wall 64*c* is flexibly deformed to move the cylindrical portion 64*a* and the depression portion 64*b* toward the pc board 70. Then the switch 64 moves toward the pc board 70 until the movable contact 66 of the cylindrical portion 64*a* is in contact with the fixed contact 71 on the pc board 70.

When depression of the push knob 10 is finished, the restoring force of the peripheral wall 64*c* of the rubber contact sheet 60 formed of the material with excellent elasticity moves the depression portion 64*b* upward while lifting the push rod 100 such that the movable contact 66 formed at the lower end of the cylindrical portion 64*a* is apart from the fixed contact 71 on the pc board 70.

The switch 65 has a large difference from the switch 64 as described above only in the configuration of the depression portion 65*b*. The slope surface 65*d* which slants from the center to the circumferential edge portion is formed at the upper end of the depression portion 65*b* of the switch 65 when seen from above. The upper end of the switch 65 is formed to have a conical shape.

Four flexible protrusions 65*e* each extending upward are provided on the slope surface 65*d* at locations apart from the circumferential edge by a predetermined distance at predetermined intervals (see FIG. 6). The switch 65 is disposed while having the protrusion 65*e* abutted on the lower end 97*a* of the support member 97 of the lens 90 so as to be urged on the push knob 20.

The lower side of the lens 90 is supported only at the switch 65 which abuts the support member 97. The support member 97 supports the center of the main body 91 of the lens 90 when seen from above. The lens 90 is allowed to be slanted in an arbitrary direction at 360° with respect to the support member 97 as the center.

Referring to FIG. 3, the push knob 20 is mounted at the center of the main body 91 of the lens 90. Upon operation of the push knob 20, the lens 90 moves only the switch 65 positioned just below toward the pc board 70.

Meanwhile, the push knob 10 is disposed in the state where the inner wall 12 is engaged with the recess portion 94 at the circumferential edge side of the lens 90. If any one of the operation positions a to d (see FIG. 1) of the push knob 10 is depressed, the resultant pressing force which acts on the push knob 10 is transferred from the inner wall 12 to the lens 90 as the force for slanting the lens 90 toward the direction of the depressed operation positions a to d.

For example, referring to FIG. 3, when the portion of the push knob 10 illustrated at the left side of the drawing is pushed toward the pc board 70, the inner wall 12 of the push knob 10 pushes the left side of the lens 90 down to the pc board 70, thus slanting the lens 90 to the left.

In the embodiment, the push knob 10 as the four-way switch is realized by arranging the switches 64 at the angular interval of 90° around the switch 65 at the center of the rubber contact sheet 60.

The switches 64 and 65 are provided at the positions corresponding to the fixed contacts 71, 72 on the pc board 70, respectively.

As illustrated in FIG. 5, the rubber contact sheet 60 has a thin portion 67 at the position corresponding to the light source 73 on the pc board 70. The thin portion 67 is provided across the light path for the light emitted from the light source 73 while connecting the mount portions 62 for preventing adhesion of dust and stain.

The thin portion 67 is considerably thinner than the other portion of the rubber contact sheet 60, and integrally formed therewith while having the thickness which allows transmission of the light emitted from the light source 73. The rubber contact sheet 60 includes the protruding wall 68 at the position corresponding to the recess groove 98 of the lens 90.

The protruding wall 68 protrudes from the upper wall 63 of the rubber contact sheet 60 toward the lens 90, and includes the plate like insertion portion 68*a* to be inserted into the recess groove 98, and a support portion 68*b* for connecting the insertion portion 68*a* to the upper wall 63 so that the insertion portion 68*a* is supported above the pc board 70 at the side of the lens 90.

The insertion portion 68*a* extends along the recess groove 98 of the lens 90 when seen from above at the side of the lens 90, and both ends in the longitudinal direction are formed to have curved surfaces (see FIG. 6).

As illustrated in FIG. 5, the support portions 68*b* have substantially a U-like cross section, and are disposed at both sides of the insertion portion 68*a* in the thickness direction (lateral direction in FIG. 5). The support portion 68*b* linearly extends from one and the other ends of the insertion portion 68*a* in the thickness direction downward of the pc board 70 lower than the upper wall 63. Then the support portion is bent in the direction away from the insertion portion 68*a* when seen from above at the side of the lens 90 to form the substantially U-like shape as a cross-section. The leading end of the support portion 68*b* is connected from the pc board 70 to the upper wall 63 of the rubber contact sheet 60.

The insertion portion 68*a* and the support portion 68*b* are connected at the position above the upper wall 63 at the side of the lens 90. The insertion portion 68*a* is movably held by the support portions 68*b* above the pc board 70 at the side of the lens 90.

In the case where the lens 90 moves toward the pc board 70 upon operation of the push knobs 10 and 20, and is interfered with the insertion portion 68*a*, the lens 90 is allowed to move without interference by easily displacing the insertion portion 68*a* while deforming the support portion 68*b*.

The height ha from the upper wall 63 to the upper end of the protruding wall 68 corresponds to the height at which the protruding wall 68 is positioned outside the recess groove 98 in the case where the lens 90 is at a normal position where it is not depressed by the push knobs 10 and 20 toward the pc board 70.

The height hb of the insertion portion 68*a* is set to the dimension of height which causes the insertion portion 68*a* to be abutted on a bottom 98*a* of the recess groove 98 when the lens 90 is at the working position under pressure by the push knob 10 against the pc board 70 (slightly longer than the depth dimension hg of the recess groove 98) for ensuring shielding of the light path across the recess groove 98 inside the lens 90.

The thickness and width of the insertion portion 68*a* are set in the range which allows insertion into the recess groove 98 for shielding the intersecting light path.

As illustrated in FIG. 2, a wiring (not shown) is formed on the pc board 70, and the fixed contacts 71, 72 paired with the movable contacts 66 of the rubber contact sheet 60, and the light source 73 as the LED are formed on an upper surface 70*a*.

The fixed contact 71 is formed on the pc board 70 just below each of the four operation positions a to d (see FIG. 1) on the push knob 10, which is opposite the movable contact 66 of the switch 64, and exposed on the surface of the pc board 70. The fixed contact 72 is formed on the pc board 70 just below the push knob 20, which is opposite the movable contact 66 of the switch 65, and exposed on the surface of the pc board 70.

A not shown connector terminal connected to the pc board 70 is capable of identifying as to which portion among the push knob 20 and operation positions of a to d of the push knob 10 has been operated, and the time taken for the operation.

Only a single unit of the light source 73 is formed on the pc board 70 for irradiating light rays toward the light receiving surface of the lens 90 located just above the light source 73.

Figure 7A:
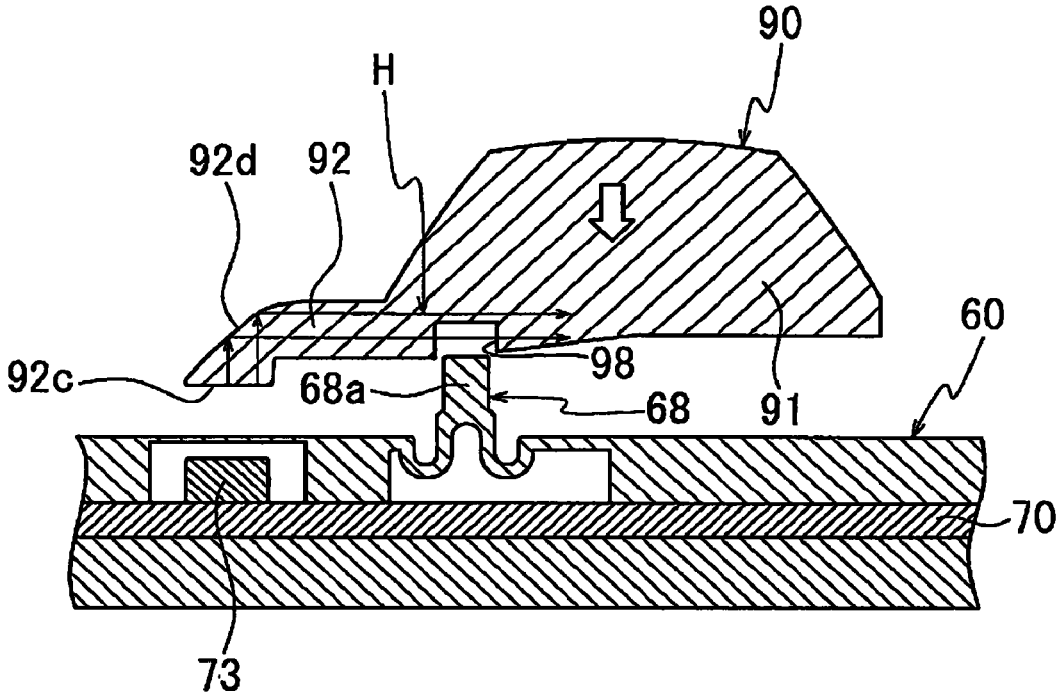
FIGS. 7A and 7B are explanatory views each representing a function of a protruding wall.
Figure 7B:
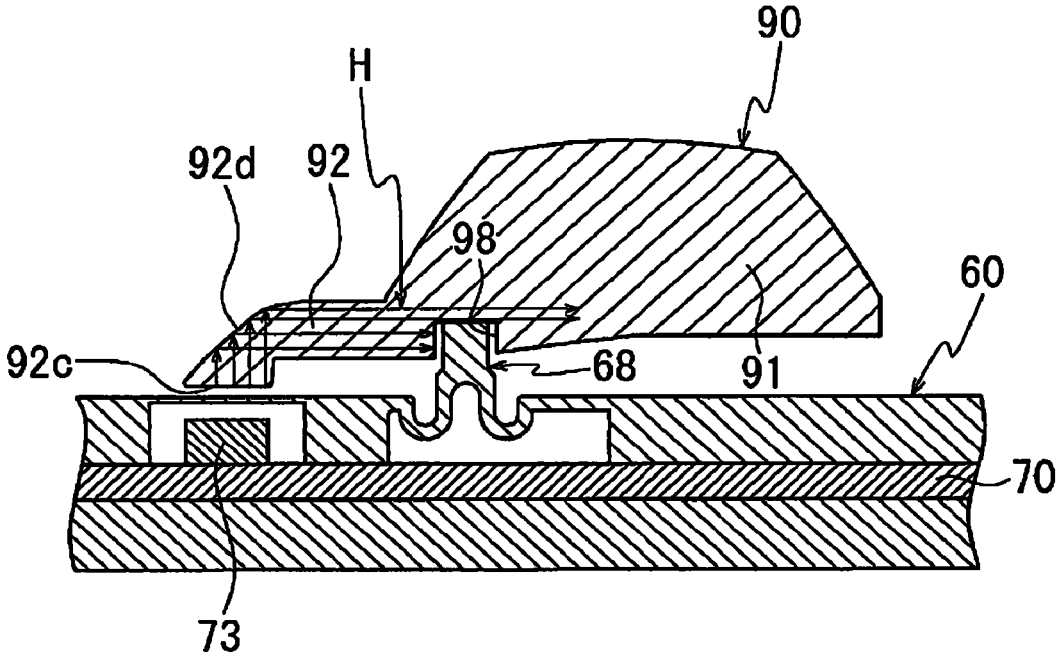

FIGS. 7A and 7B are explanatory views each representing a function of the protruding wall 68. Specifically, FIG. 7A is a view in the case where the lens 90 is at a normal position before moving toward the pc board 70. FIG. 7B is a view in the case where the lens 90 has moved to the pc board 70 at an operation position, and the insertion portion 68*a* of the protruding wall 68 is inserted into the recess groove 98.

An operation of the protruding wall 68 in the thus structured switch 1 will be described.

In the case where the push knobs 10 and 20 are not operated, and the lens 90 is at the normal position, the insertion portion 68*a* of the protruding wall 68 is positioned outside the recess groove 98 of the lens 90 as illustrated in FIG. 7A.

The incident light from the light source 73 to the lens 90 from the incident surface 92*c* is reflected on the slope surface 92*d*, and passes the recess groove 98 so as to be guided into the main body 91 of the lens 90. It is then irradiated from the output surfaces 93*a*, 95*a* and 95*b* (see FIG. 3) of the lens 90 for illuminating the push knobs 10 and 20.

That is, all the incident light rays to the lens 90 are used for illuminating the push knobs 10 and 20.

In the case where the push knobs 10 and 20 are operated, and the lens 90 moves from the position illustrated in FIG. 7A toward the arrow direction, the insertion portion 68*a* of the protruding wall 68 is inserted into the recess groove 98 by the amount corresponding to the displacement of the lens 90.

As the lens 90 moves toward the pc board 70, the distance between the incident surface 92*c* of the lens 90 and the light source 73 on the pc board 70 is reduced. The amount of the incident light to the lens 90 from the incident surface 92*c* may be increased by the degree corresponding to the reduced distance.

In the embodiment, the insertion amount of the insertion portion 68*a* into the recess groove 98 is increased accompanied with increase in the amount of the incident light to the lens 90 resulting from its movement toward the pc board 70, thus increasing the light shielding level at the portion of the light path H which passes through the recess groove 98.

In the case where the push knob 10 is fully pushed to move the lens 90 to the operation position closest to the pc board 70, the light at the position of the light path H, which does not pass through the recess groove 98 is only used for illuminating the push knobs 10 and 20.

In the embodiment, accompanied with the movement of the lens 90 to increase amount of the incident light thereto, the light ray used for illuminating the push knobs 10 and 20 is narrowed. Then the depth and range of the recess groove 98, and the insertion amount of the insertion portion 68*a* into the recess groove 98 are determined so that the push knobs 10 and 20 are illuminated with the light by substantially the same amount in the case where the lens 90 is not moved.

This makes it possible to favorably prevent intensity for illuminating the push knobs 10 and 20 from largely fluctuating owing to the change in the distance between the incident surface 92*c* of the lens 90 and the light source 73 upon operation of the push knobs 10 and 20.

The push knobs 10 or 20 in the embodiment correspond to the knob according to the present invention, and the rubber contact sheet 60 corresponds to the retainer member according to the present invention.

As described above, the switch 1 in the embodiment is provided with the push knobs 10, 20 for operating the movable contact 66, the light source 73 disposed on the pc board 70, and the lens 90 which guides the light ray from the light source 73 toward the push knobs 10, 20 so as to be illuminated, and structured to move the lens 90 by operating the push knobs 10, 20 to change the distance between the incident surface 92*c* of the lens 90 and the light source 73. The lens 90 is provided with the recess groove 98 which intersects the light path H of the incident light to the lens 90. The protruding wall 68 which protrudes toward the lens 90 is formed on the pc board 70 at the position corresponding to the recess groove 98. When the lens 90 moves toward the direction to reduce the distance between the incident surface 92*c* and the light source 73, the insertion portion 68*a* of the protruding wall 68 is inserted into the recess groove 98 by the amount corresponding to the displacement of the lens 90 such that the light path H is shielded by the insertion portion 68*a* in accordance with the displacement of the lens 90.

As the amount of the incident light to the lens 90 which moves toward the direction to reduce the distance between the incident surface 92*c* and the light source 73 is increased more, the insertion amount of the insertion portion 68*a* into the recess groove 98 becomes large, thus increasing the level for shielding the light path H by the insertion portion 68*a*. Meanwhile, as the amount of the incident light to the lens 90 which moves toward the direction to increase the distance between the incident surface 92*c* and the light source 73 is decreased, the insertion amount of the insertion portion 68*a* into the recess groove 98 becomes small, thus reducing the level for shielding the light path H by the insertion portion 68*a*.

The above-described structure is capable of keeping the amount of the light for illuminating the push knobs 10, 20 substantially constant irrespective of the change in the distance between the incident surface 92*c* and the light source 73. This may prevent large change in the illumination luminance for the push knobs 10, 20 caused by the change in the distance between the incident surface 92*c* of the lens 90 and the light source 73 upon operation of the push knobs 10, 20.

The lower surface 91*a* of the lens 90 at the side of the pc board 70 is supported at the rubber contact sheet 60 for movably holding the movable contact 66 above the fixed contact 71 on the pc board 70 to be close thereto or away therefrom. The push knobs 10 and 20 are mounted on the lens 90.

When the push knobs 10 and 20 are operated and depressed toward the pc board 70, the lens 90 moves toward the pc board 70 together with the push knobs 10 and 20. Each displacement of the push knobs 10 and 20 directly reflects the displacement of the lens 90. Accordingly, the shielding level of the light path H by the protruding wall 68 may be set to the appropriate value in accordance with the actual displacement (operation amount) of the push knobs 10 and 20.

The protruding wall 68 is integrally formed with the rubber contact sheet 60 which constitutes the switches 64 and 65 for detecting operations of the push knobs 10 and 20.

Compared with the case where the protruding wall 68 is provided separately from the rubber contact sheet 60, the protruding wall 68 in the embodiment may be disposed with high positional accuracy. The rubber contact sheet 60 having the protruding wall 68 and the switches 64, 65 already formed may be obtained, thus eliminating the manufacturing steps, and contributing to the cost reduction for manufacturing the switch 1.

The protruding wall 68 is provided with the insertion portion 68*a* configured to be mated with the recess groove 98, and the support portion 68*b* so as to be movably supported above the pc board 70 at the side of the lens 90. It is formed of the rubber material with excellent flexibility and elasticity, and integrally formed with the rubber contact sheet 60.

When the push knobs 10, 20 are operated to depress the lens 90, movement of the lens 90 is not interfered with the insertion portion 68*a* which is depressed by the lens 90 toward the pc board 70.

The use of the material with excellent flexibility and elasticity for forming the protruding wall 68 may protect the protruding wall 68 from being broken due to fatigue resulting from repetitive interference caused by the moving lens 90.

The embodiment explains the case where the light source 73 is directly attached to the pc board 70. However, any structure may be formed so long as the incident light to the lens 90 from the light source 73 is guided to the push knobs 10 and 20. For example, the light source may be provided at the position away from the pc board through connection with the lead wire extending from the pc board terminal. Alternatively, the light source may be attached to the terminal block having the conductive plate conducted to the terminal or the fixed contact insert molded using the insulating resin instead of the use of the pc board.

What is claimed is:

1. A switch comprising:

a knob used for operating a movable contact;

a light source; and a lens for guiding a light ray from the light source to illuminate the knob, the lens being moved by operating the knob to change a distance between the lens and the light source, wherein:

the lens is provided with a recess groove which intersects a light path of incident light to the lens;

a protruding wall which protrudes toward the lens is formed on a substrate at a position corresponding to the recess groove; and when the lens moves toward a direction to reduce the distance from the light source, the protruding wall is inserted into the recess groove by an amount corresponding to a displacement of the lens to shield the light path in accordance with the displacement.

2. The switch according to claim 1, wherein:

a lower surface of the lens at a side of the substrate is supported at a retainer member for retaining the movable contact above a fixed contact of the substrate; and the knob is mounted on the lens.

3. The switch according to claim 2, wherein the protruding wall is integrally formed with the retainer member.

4. The switch according to claim 1, wherein the protruding wall includes an insertion portion configured to be mated with the recess groove, and a support portion for movably supporting the insertion portion above the substrate at a side of the lens.

5. The switch according to claim 2, wherein the protruding wall includes an insertion portion configured to be mated with the recess groove, and a support portion for movably supporting the insertion portion above the substrate at a side of the lens.

6. The switch according to claim 3, wherein the protruding wall includes an insertion portion configured to be mated with the recess groove, and a support portion for movably supporting the insertion portion above the substrate at a side of the lens.

* * * * *